United States Patent [19]

Wagner, III

[11] Patent Number: 4,598,510

[45] Date of Patent: Jul. 8, 1986

[54] MODULAR AND EXPANDABLE PLATFORM SYSTEM

[76] Inventor: Fred A. Wagner, III, P.O. Box 607, Livermore, Calif. 94550

[21] Appl. No.: 636,550

[22] Filed: Aug. 1, 1984

[51] Int. Cl.[4] ..... E04B 5/02

[52] U.S. Cl. ..... 52/126.6

[58] Field of Search ..... 52/126.6, 126.1, 126.5, 52/126.7, 182, 184, 183

[56] References Cited

U.S. PATENT DOCUMENTS

| | | | |
|---|---|---|---|
| 3,318,057 | 5/1967 | Norsworthy | 52/126.6 |
| 3,470,663 | 10/1969 | Tate | 52/126.6 |
| 3,811,237 | 5/1974 | Bettinger | 52/126.6 |
| 4,277,923 | 7/1981 | Rebentisch et al. | 52/126.6 |

*Primary Examiner*—Stanley N. Gilreath
*Attorney, Agent, or Firm*—Owen, Wickersham & Erickson

[57] ABSTRACT

A raised-platform type of structure, including a rectangular frame having two longitudinal and two lengthwise bars fastened together at the corners with midpoints of longitudinal bars and, fastened to them, a series of tubular legs or leg receptacles, one secured adjacent each corner of the frame. Each receptacle, if any, has tubular legs slidably mounted in it and releasable means for rigidly securing the leg to its receptacle. A jack screw fits loosely in each leg and extends therebelow, and a jack nut is threaded on each jack screw to abut and support the leg. A locking nut is threaded on the lower end of each jack screw. A floor rests on and is supported by the rectangular frame.

30 Claims, 10 Drawing Figures

MODULAR AND EXPANDABLE PLATFORM SYSTEM

This invention relates to a modular and expandable platform system which may be either permanently or portably placed and may be adapted for ready disassembly and re-assembly.

BACKGROUND OF THE INVENTION

Structures have become increasingly expensive, and to provide decks, ramps, and other types of supporting structure has often involved major expenses, besides requiring in many instances special drawings and special parts.

The modular flooring system of the present invention serves a variety of building needs and applications with little, and in some cases no, site preparation involved.

The invention may be used for either permanent site building or for knock-down or portable systems. It may be used for aiding construction work on permanent structures, or may be itself a building or industrial or commercial display system. A prime use of it is for residential decking, but it may also be used for flooring for greenhouses or metal buildings, or for other outside structures. It may used to enclose and support hot tubs and spas.

The invention may be used for any type of decking that is used for elevated display areas, recreational platforms, stages, and permanent subflooring. It is ideal for on-site construction flooring, and for all types of elevated platforms, scaffolds, adjustable tables, and large scale storage shelving.

The structure may be mounted on wheels or castors for use as a rolling platform or the like.

The invention is made so that it can be installed quickly without having to build any foundations, resting on such foundations as are available, including prefabricated support members.

The system is easy to install, and requires no special tools or even skilled labor. An all-steel frame assembly is employed with self leveling leg jacks resting on suitable retainer pads or other supports. Most parts are readily bolted together.

It is possible to make very large areas of decking and the like by securing together a number of modular units. It is also feasible to use the invention for ramps, which may be either left permanently in place or may be wheel mounted, on either or both ends.

Thus, the invention has among its objects a provision of relatively inexpensively installed support systems for decks and other uses; it is especially cost-advantageous when it is to be later taken down and re-used elsewhere.

Another object is to provide such a system which can be installed using few tools, and those are conventional tools, rather than requiring special tooling.

Another object is to provide such a system that can be installed without the necessity of skilled labor at the installing spot.

SUMMARY OF THE INVENTION

The invention provides a raised platform having a rectangular frame that is defined by four tee bars, two longitudinal and two lengthwise, each with a vertical flange and a horizontal flange, welded together at the corners. The horizontal flange extends inwardly of the rectangle, and a central bar extends widthwise across the midpoints of the longitudinal tee bars and is welded to them. A series of tubular leg receptacles is secured to the frame, one being secured, as by welding, adjacent each corner of the frame. Each leg receptacle comprises a length of vertically disposed square tubing.

A corresponding series of square tubular legs is slidably mounted in the leg receptacles, and the legs are rigidly secured to their respective leg receptacles at a chosen location relative thereto, preferably by set screws. Each leg has a flat lower end.

A jack screw is loosely mounted in each leg and extends therebelow. The screw has a through diametral opening near its lower end. A jack nut is threaded on each jack screw and has a flat upper end abutting and supporting the flat lower end of each leg. Also, a locking nut is threaded on each jack screw below the jack nut.

Preferably, there is a jack receptacle for receiving the lower end of each jack screw and for supporting it. The receptacle has an outwardly extending flange and may be contained in a flat-bottomed concrete pad. The flange is then embedded in the pad and strengthens it.

A floor rests on the horizontal flanges of the frame and abuts its vertical flanges. This floor may comprise a series of planks parallel to each other and a pair of supporting stringers below and secured to the planks.

The invention also comprises a platform assembly made up of a plurality of the platform as just described, secured together. In such an assembly, the jack receptacles for closely adjacent-jacks may comprise a common receptacle assembly having two spaced-apart receptacles, one for each jack screw and having a common horizontal flange encased in a single concrete pad.

The invention also includes a step assembly secured to the platform. This step assembly preferably includes an additional pair of leg receptacles like those of the frame, each having associated with it, as in the platform, a leg, a set screw, a jack screw, a jack nut, a locking nut and a jack receptacle. A horizontal angle member bridges this pair of leg receptacles. There is also a pair of horizontal members, each normal to that horizontal angle member, one being secured to each leg receptacle and, at its opposite end having a sleeve slidably mounted on one of the legs of the frame. A tread is supported on the horizontal members.

The step assembly may include one or more additional step assemblies like that just described with its sleeves mounted on the leg of the formerly stated assembly.

One leg at the lowest step may project above the step, as may one leg for the platform to which the step assembly is secured. A banister or railing is then secured to and connects the upper ends of those upwardly projecting receptacles. Complete modular metal railings may be used.

The platform may have an outer facing or a railing secured to its vertical flanges. Again, metal, wood, or plastic railings may be used and they may be modular.

The invention may also provide a ramp with only one pair of leg receptacles, one receptacle being secured adjacent each corner at one end only of the rectangular frame. Legs and the screw assembly fit therein. Or there may be two pairs of leg receptacles with different length legs therein.

DESCRIPTION OF SOME PREFERRED EMBODIMENTS

Figure 1:
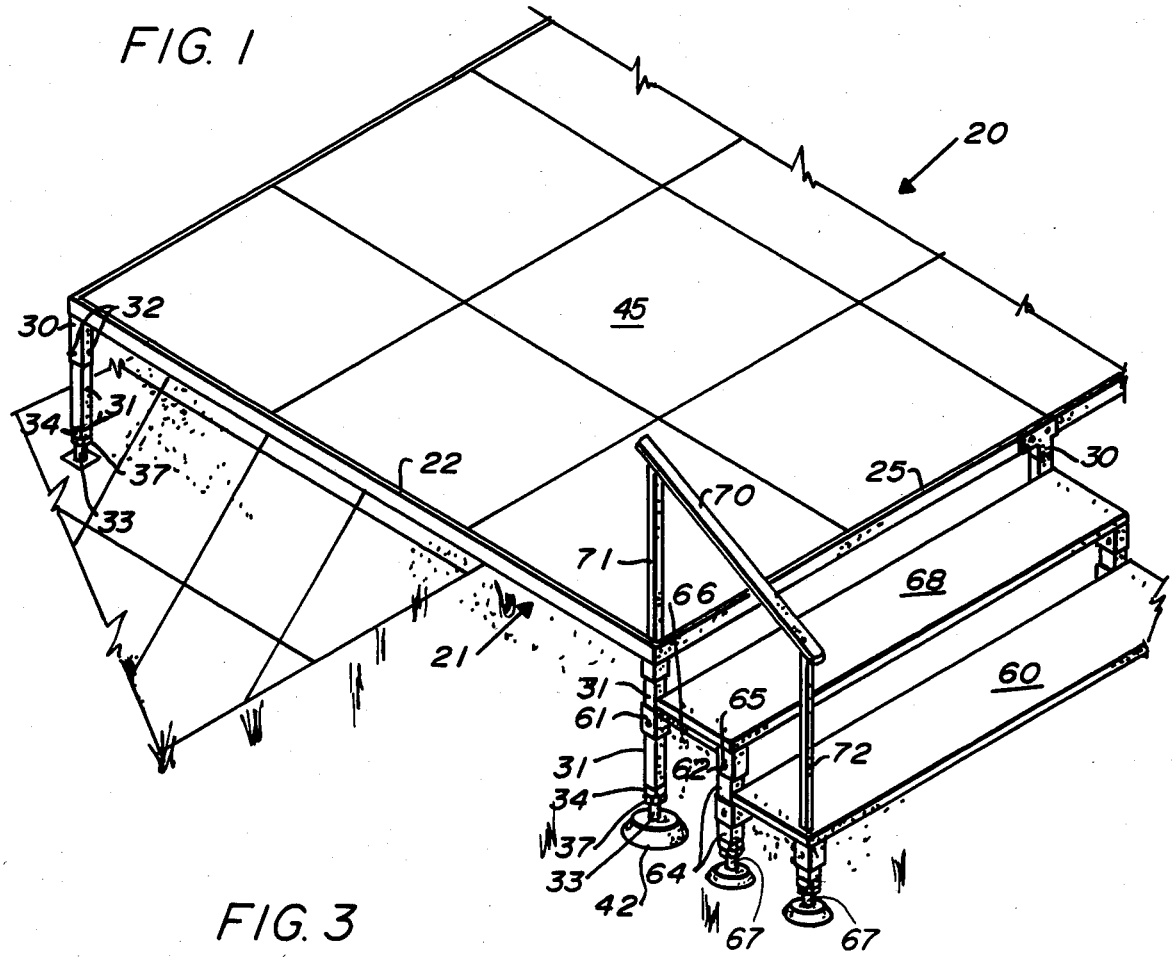
FIG. 1 is an isometric view of a platform embodying the principles of the invention, with steps leading up to the platform's deck.
Figure 3:
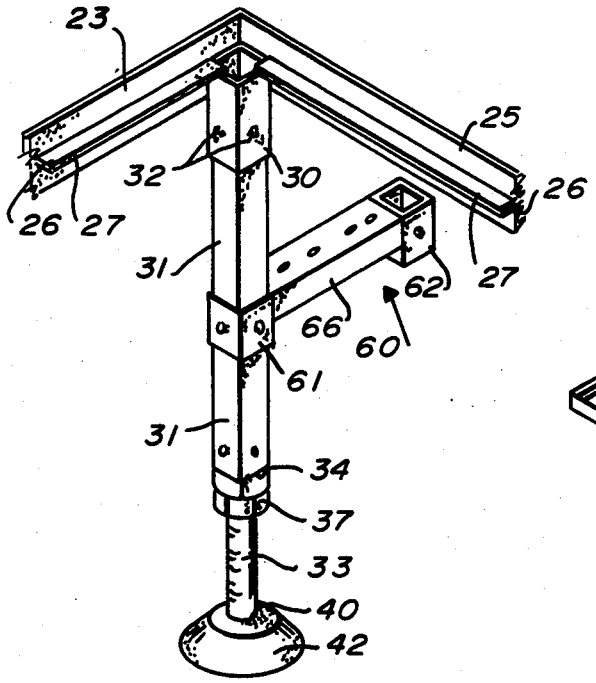
FIG. 3 is a fragmentary enlarged isometric view of a portion at one of the step corners of FIG. 1.
Figure 2:
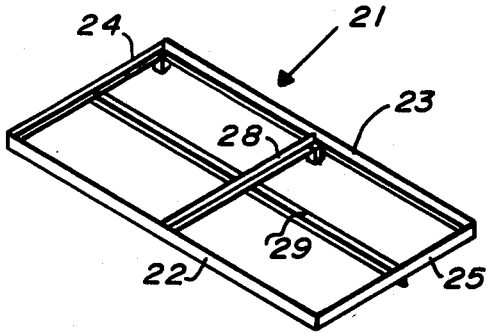
FIG. 2 is an isometric view on a reduced scale of the main frame of the platform of FIG. 1.

A basic platform (FIGS. 1–3)

A platform 20 according to the principles of the invention as shown in FIG. 1 and includes a main frame 21 shown in FIG. 2. The frame 21 may be made to various dimensions, but typically is made either square or rectangular in sizes such as from about 4'×4' to about 8'×20'. In general it may be said that there are two types of such frames, one that can be assembled with other elements, as in FIG. 1 and one for permanent flooring. In both types, the frame 21 may comprise four tee bars 22, 23, 24, and 25. Two bars 22 and 23 are disposed longitudinally and the other two bars 24 and 25 extend widthwise. Each bar 22, 23, 24, and 25 has a vertical flange 26 (see FIG. 3) and a centrally located horizontal flange 27. These bars 22, 23, 24, and 25 are welded together at the four corners of the rectangular frame 20, with the horizontal flanges 27 all extending inwardly of the rectangle. Preferably, there is additionally at least one strengthening member, such as an angle bar 28 extending widthwise across the midpoints of the longitudinal channel bars 22 and 23 (FIG. 2), and welded to them. Additionally there may be another lengthwise-extending such reinforcement member 29 welded to the lower edges of the two shorter bars 24 and 25 at their midpoints.

Figure 4:
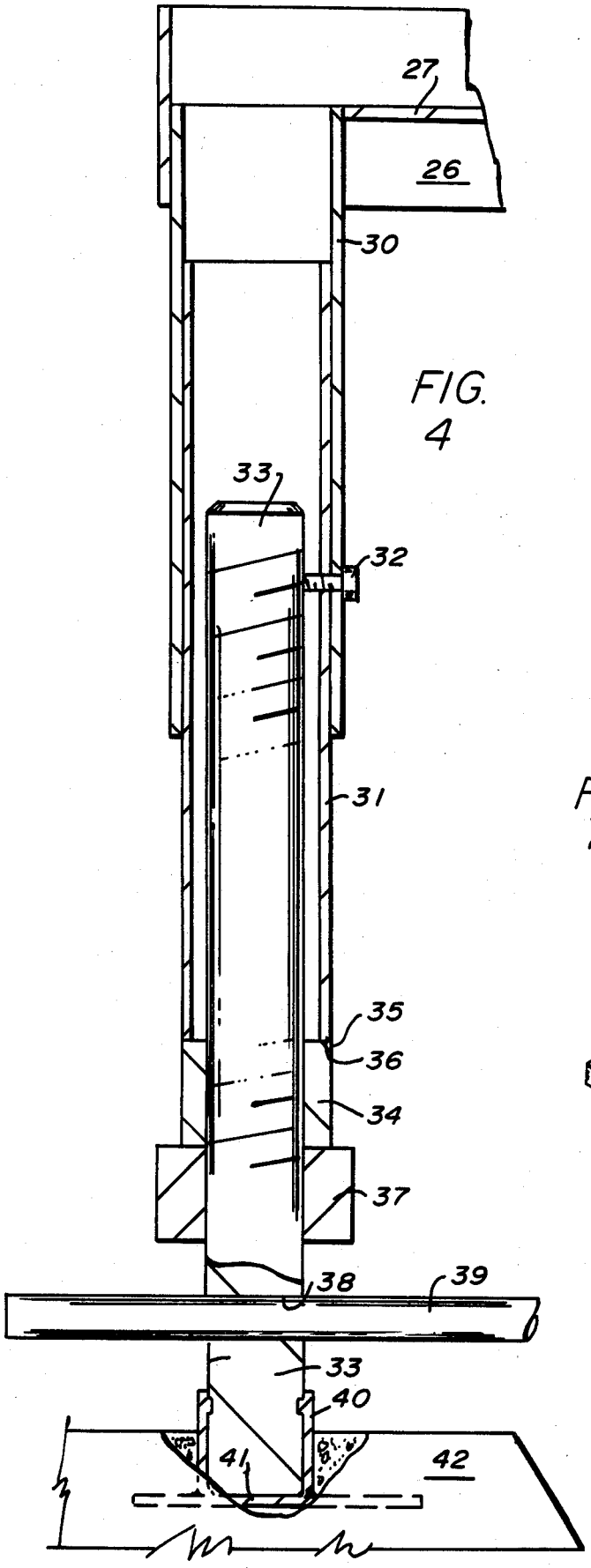
FIG. 4 is a further enlarged view in elevation and in section of one of the legs during installation.

The leg assemblies (FIGS. 1, 3 and 4)

At or adjacent each corner of the main frame 21 is secured a leg receptacle 30. The leg receptacles 30 are square tubes, which may be directly welded to the frame 21, or may, if desired, be provided with flanges that are bolted to the main frame 21. These members extend vertically. The horizontal flange 26 may extend in to the leg receptacle 30 sufficiently to provide a stop.

In each leg receptacle 30 is mounted a leg 31. It is possible to do away with the receptacle 30 and bolt or weld the legs 31 directly to the frame 21, but the preferable structure is that shown. The legs 31 are smaller square tubes that fit slidably within the leg receptacles 30. Preferably, the receptacles 30 are provided with set screws 32 or other means for locking the legs 31 to the receptacles 30. Typically there may be two such set screws 32 on each of two sides of the leg receptacle. Thus, the legnth of the legs 31 may be adjusted relative to the frame 21, so that the frame 21 will be level or at a desired inclination, as for an inclined platform or a ramp.

Since the legs 31 themselves are hollow tubes, a jack screw 33 (see FIG. 4) is inserted into each leg 31 and is freely movable within it. Typically, these jack screws 33 are one inch in diameter with about eight threads to the inch; they may come in various lengths. With these are used two nuts, one of them being a jack nut 34 that has a flat upper surface 35 which abuts and supports a flat lower surface 36 of its leg 31. To prevent slippage or shifting, a lock nut 37 is preferably employed below the jack nut 34. Near, but above, the lower end of the jack screw 33 is a diametral hole 38 extending through the screw so that a rod 39 can be used to turn the screw 33 and adjust the height of the platform.

The lower end of the jack screw 33 is mounted in a suitable receptacle 40. Preferably the receptacle 40 corresponds roughly to the outside dimensions of the lower end of the jack, but is also, preferably, provided with one or more flanges extending at right angles to the cup-shaped receptacle 40. In some instances this alone may be sufficient, as where it is to rest on a concrete floor, but for outside installation it is advisable to use a concrete pod 42, in which the retainer cup 40 and its load diffusing flange 41 are embedded. This spreads the narrow, nearly single-point load of the jack screw 33 over a relatively large surface area. It is easy to provide suitable footing for these pods 42, especially since they do not all have to be on the same level, due to the adjustability provided by the jack screws 33.

A deck floor 45 or surfacing rests on the horizontal portions 27 of the tee bars 22, 23, 24, and 25. The deck 45 may be made of wood, metal, or plastic. It is typically made in square panels with suitable stringers tying it together, and may be prepared at the factory to fit exactly.

Figure 5:
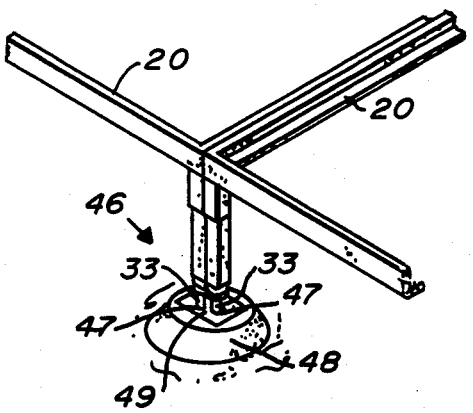
FIG. 5 is an isometric view of a portion of a platform assembly utilizing a plurality of platforms like that of FIG. 1.

Combining platforms (FIG. 5)

It is quite feasible to provide a larger platform by combining a plurality of platforms 20 and securing them together, usually by bolting, but, alternatively, they may be welded together. Such an assembly may utilize a jack receptacle assembly 46 in which closely adjacent pairs of jack screws 33 utilize a pair of spaced apart receptacles 47 in a single pod 48, one for each jack screw 33. These receptacles share a common horizontal flange 49 that is encased in the single concrete pod 48.

Figure 7:
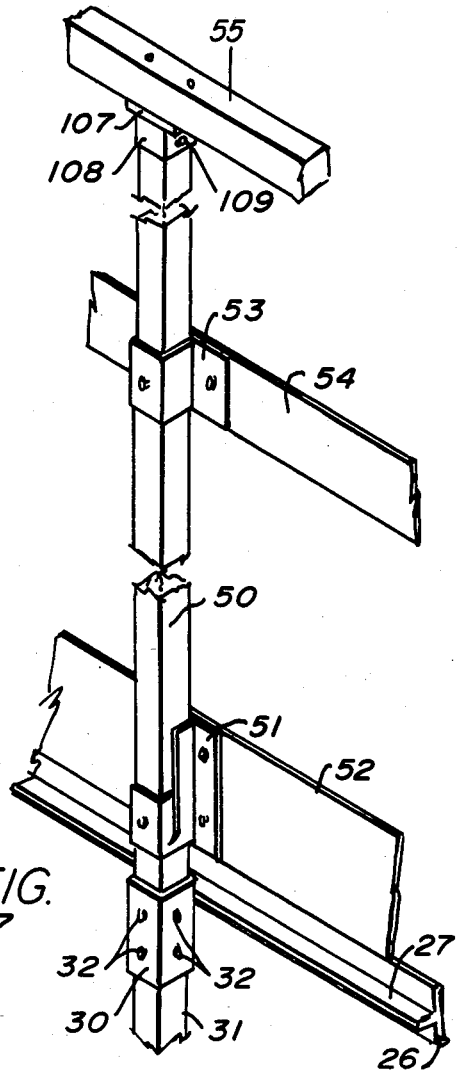
FIG. 7 is a fragmentary isometric view of a portion of an extended platform like that of FIG. 6 but having a railing therearound. The view is broken in the middle as well as the ends.
Figure 6:
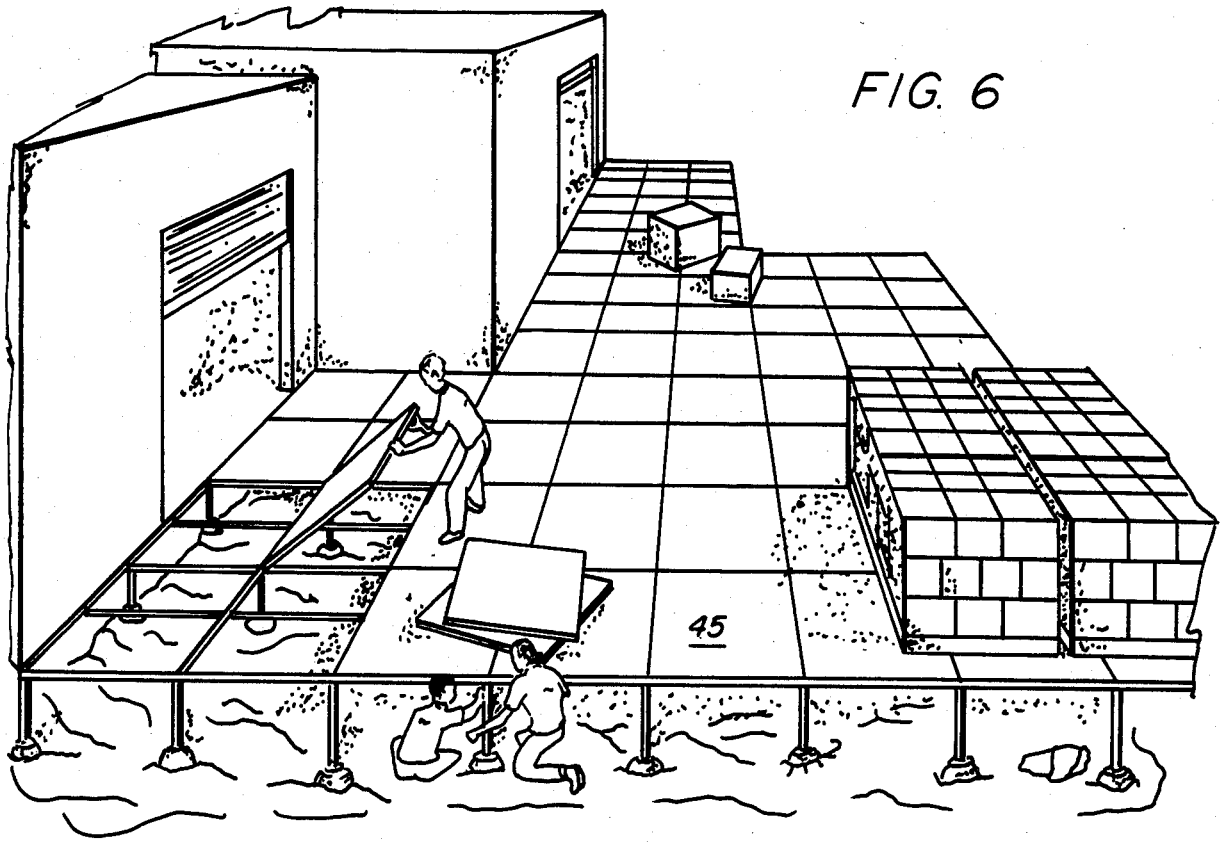
FIG. 6 is a perspective view of a large platform.

An extended larger platform (FIGS. 6 & 7)

Alternatively, as shown in FIG. 6, the platform may be continued on by using, in addition to one leg at each corner, legs at various intermediate locations. Some details are shown in FIG. 7.

FIG. 7 shows that the leg receptacles 30 may be used to receive vertical railing support members 50 from above. Also, a bracket 51 secured to support members 50 may be secured to a baseboard 52 resting atop the outside flange 26 of the frame 21. Higher up, a bracket 53 is secured to the member 50 and supports an intermediate rail 54. Above that, the member 50 may support a top rail 55.

Installation

In indoor installations, the cups 40, 41 supporting the jack screws 33 may be either approximately located, or permanently located, if there is careful measurement. The platform 20 may then be assembled at the location. The jack screws 33 with their nuts 34 and 37 may be placed in the receptacle 40. Then the legs 31, which are already inside the receptacles 30 are placed over the screws and height is adjusted.

For outdoor installation the pods 42 are approximately located, the surface under them preferably being leveled with a spade, or a ground shaver. The platform 20 is then built up in situ.

Figure 8:
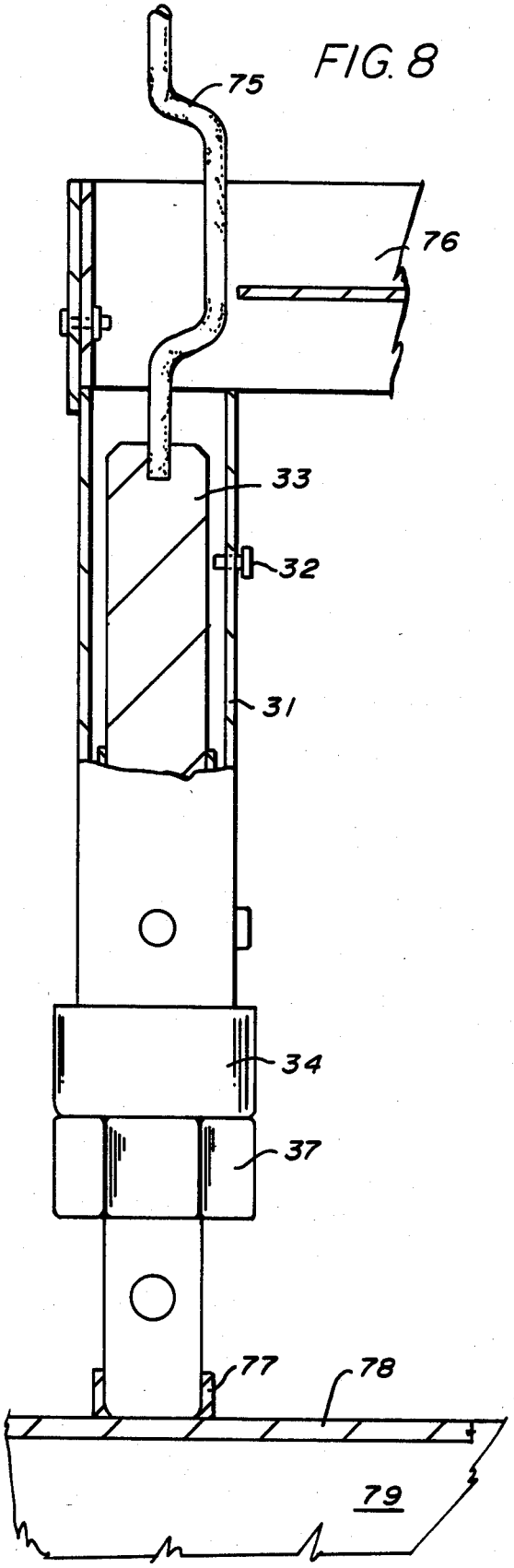
FIG. 8 is view in elevation and partly in section of one leg and adjacent portions showing the use of an installation driving tool from above.

As shown in FIG. 8, in place of using the rod 39 shown in FIG. 4, it is possible to work on the screw 33 from above, using a driver 75. The view also show a modified form of platform 76. Further, the jack screw 33 rests in a receptacle 77 that is welded atop a steel plate 78; the steel plate 78 is embedded in a concrete base 79.

Under normal conditions, a single type and size of set screws, railing fasteners, bolts etc. can be used. For example, all may be 7/16" members with a $\frac{5}{8}$" hexagonal head, so that a single wrench can be used in assembling the entire structure.

Steps (FIGS. 1 & 3).

Steps may be provided by an auxiliary frame member 60 comprising a pair of square tubes 61 and 62 like the leg receptacles 30, one fitting around a leg 31 and locked to it by set screws 63, while the other tube 62 has a step leg 64 associated with it and locked to it by the set screws 65. The receptacles 61 and 62 are joined by a tread-supporting bar 66. Another jack screw 33, jack nut 34 and its locking nut 37 are associated with the step leg 64, and a jack receptacle 67 is provided. A tread 68 bridges a pair of bars 66, either with or without cross bars.

There may be a plurality or series of such steps joined together, as shown in FIG. 1. Each is made substantially as just described, with each auxiliary frame member 60 being joined to the leg 64 for the next higher step, and the highest one joined to the platform frame 21, as shown. Similarly, there may be a banister 70 at one or both sides of the steps. This may be provided by upright members 71 and 72 which may be a continuation of the leg 64 projecting up to banister height. One upright 71 may be at the highest and the other upright 72 at the lowest level, so that a banister strip 70 may join them together.

Figure 9:
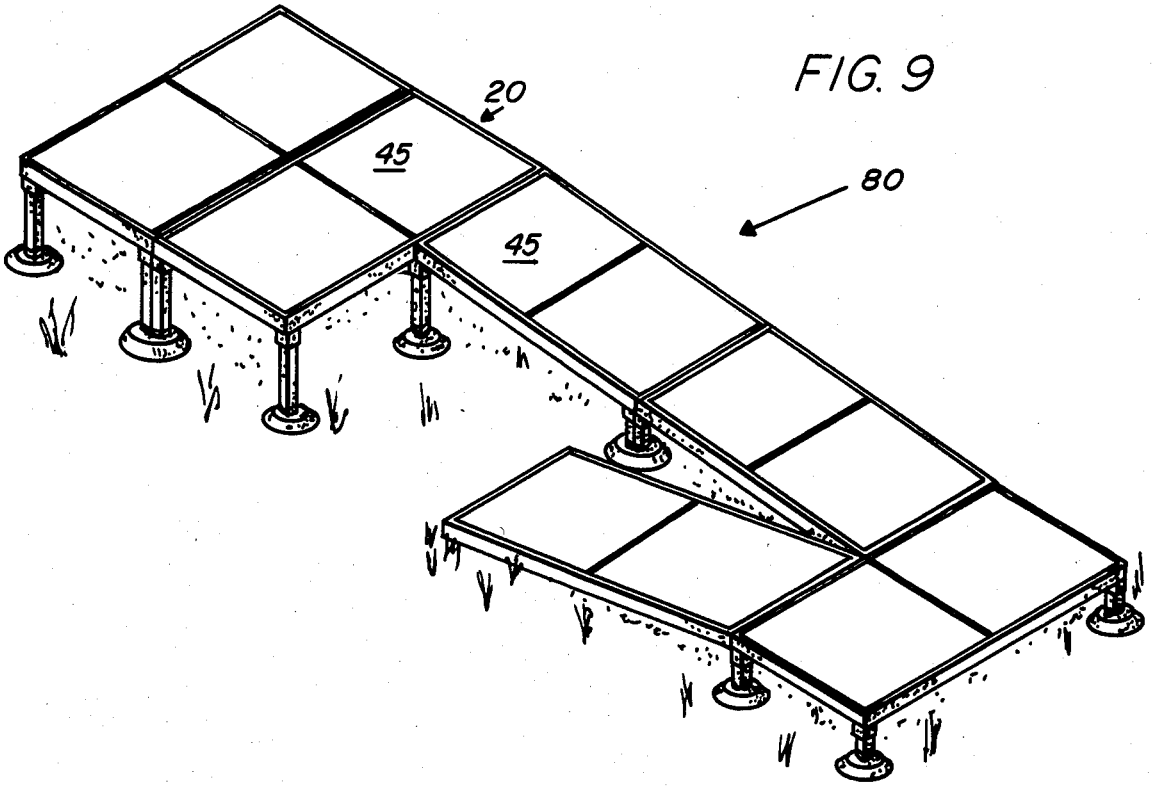
FIG. 9 is an isometric view of a ramp embodying the principles of the invention.

Ramps (FIG. 9).

In many instances it is desirable to have a ramp 80, like that of FIG. 9, leading up to the platform deck, and in those instances the ramp 80 may be constructed just like the platform of FIG. 1, except that the pairs of legs are of different lengths, or, in fact, there may be only legs at one end of the ramps to raise it up to the level of the platform while the other end may be at ground level.

Figure 10:
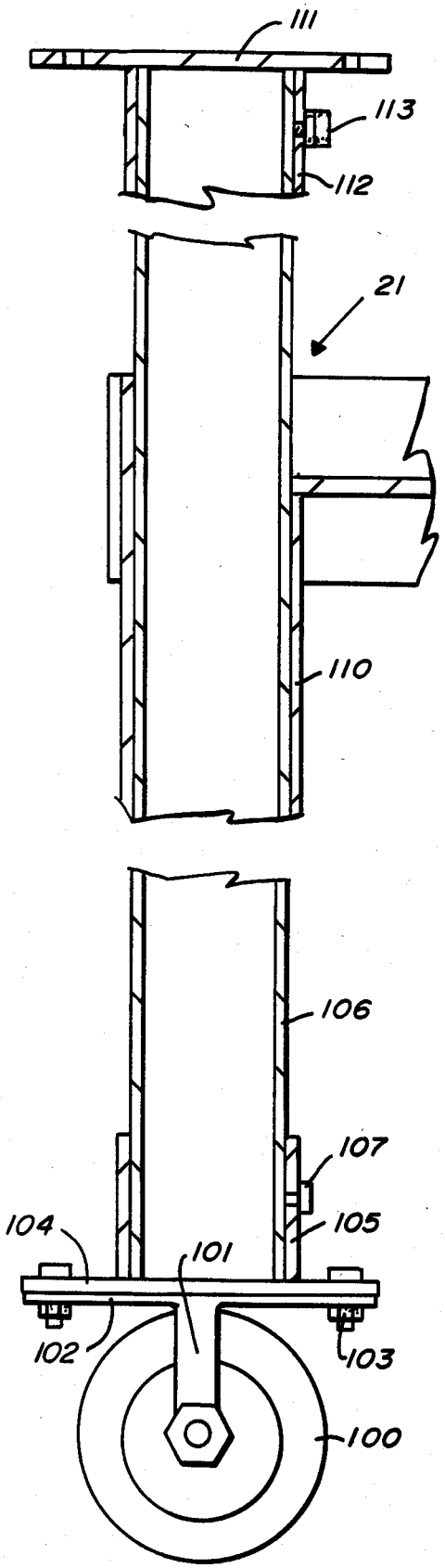
FIG. 10 is view in elevation and in section of a portion of the device showing one of the legs mounted on a wheel plate so that the entire assembly is mounted on wheels and is movable.

Wheel-supported platform (FIG. 10).

FIG. 10 shows how the platform may be wheel supported. A wheel 100 has a castor support 101 which extends up to a castor plate 102, which is bolted by bolts 103 to another plate 104. The plate 104 is secured to the lower end of a tube 105 that surrounds a leg 106 of the platform. A set screw 107 enables adjustment of the tube 105 in the leg 106. The frame 21 has a leg receptacle 110, the set screw 32 being carried on the broken-off portion of the receptacle 110, and the leg 106 extends through it to provide a vertical support above the deck, its upper end being secured to a header 111 by a bracket 112 welded to the header and having set screws 113. The header 111 then serves as a hand railing or the like.

Various sizes of frames may be provided, and the shape can readily be varied for strictly rectangular shapes.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A raised-platform type of structure, including in combination a rectangular frame having four load supporting bars, two widthwise and two lengthwise fastened together at the corners, a series of square tubular leg-providing means, one secured adjacent each corner of the rectangular frame, each leg-providing means comprising a length of square tubing disposed vertically and a flat lower end, each said leg-providing means comprising a square tubular leg receptacle open at each end secured to said frame, a square tubular leg slidable inside each leg receptacle, and separate releasable locking means for holding said leg and receptacle together positively, a jack screw fitting loosely in each said tubular leg and extending therebelow, a jack nut threaded on each said jack screw and abutting and supporting the flat lower end of each said leg-providing means, a locking nut threaded on each said jack screw below said jack nut, and a floor resting on and supported by said rectangular frame.

2. The structure of claim 1 wherein said jack screw has driving means at its upper end and near its lower end.

3. The structure of claim 1 having a jack receptacle for receiving the lower end of each said jack screw and supporting it, said jack receptacle being contained in a flat-bottomed concrete pad, said receptacle including means for spreading and diffusing the load thereon within said pad.

4. An assembly made up of a plurality of the structures of claim 1 secured together, the jack receptacles for closely adjacent-jacks comprising a common receptacle assembly having two spaced-apart receptacles, one for each jack screw, and having a common horizontal flange and a single concrete pad encasing said receptacles and said flange.

5. The structure of claim 1 having a plurality of a square tubular railing supports, each secured to one of a plurality of said leg receptacle and fitting inside it at its lower end, and at least one railing secured to the upper end of said support.

6. The structure of claim 5 in which a plurality of parallel railings are secured to said supports.

7. The structure of claim 5 in which said railing supports are extensions of said legs.

8. The structure of claim 5 in which said railing supports are separate from said legs.

9. A raised-platform type of structure, including in combination a rectangular frame having four load-bearing bars, two widthwise and two lengthwise fastened together at the corners, and a central bar extending widthwise across the midpoints of the lengthwise bars and fastened to them, a series of tubular leg receptacles fully open at each end, one secured adjacent each corner of the rectangular frame, each leg receptacle comprising a length of tubing disposed vertically, a corresponding series of tubular legs slidably mounted in said leg receptacles and having a flat lower end, releasable means for rigidly securing each said leg to its said leg receptacle at a chosen location relative thereto, a jack screw fitting loosely in each said leg and extending therebelow, a jack nut threaded on each said jack screw and abutting and supporting the flat lower end of each said leg, a locking nut threaded on each said jack screw below said jack nut, and a floor resting on and supported by said rectangular frame.

10. The structure of claim 9 having a jack receptacle for receiving the lower end of each said jack screw and supporting it, said receptacle having at its lower end a load-diffusing flange, said jack receptacle being contained in a flat-bottomed concrete pad, said flange being embedded in and strengthening said pad.

11. The platform of claim 9 wherein a castor is attached to the lower end of each said jack screw so that said castors support said platform.

12. A raised-platform type of structure, including in combination a rectangular frame having four bars, two widthwise and two lengthwise fastened together at the corners, and a central bar extending widthwise across the midpoints of the lengthwise bars and fastened to them, a series of tubular leg receptacles, one secured adjacent each corner of the rectangular frame, each leg receptacle comprising a length of tubing disposed vertically, a corresponding series of tubular legs slidably mounted in said leg receptacles and having a flat lower end, releasable means for rigidly securing each said leg to its said leg receptacles at a chosen location relative thereto, a jack screw fitting loosely in each said leg and extending therebelow, a jack nut threaded on each said jack screw and abutting and supporting the flat lower end of each said leg, a locking nut threaded on each said jack screw below said jack nut, a floor resting on and supported by said rectangular frame, a step assembly secured thereto, said step assembly including an additional pair of said leg receptacles, each having an associated leg, set screw means, a jack screw, a jack nut, a locking nut and a jack receptacle, a first horizontal rigid member bridging said pair of leg receptacles, a pair of other horizontal members each normal to said first horizontal member, one being secured to each said leg receptacle and also at its opposite end having a sleeve slidably mounted on one of said legs of said frame, and treads supported on said horizontal members.

13. The platform of claim in 12 wherein said step assembly includes an additional step assembly like that recited in claim 11 with its said sleeves mounted on the leg of the formerly stated assembly.

14. The platform of claim 13 wherein one said leg at the lowest said step projects above the step and so does one leg for the platform to which the step assembly is secured and a banister secured to and connecting the upper ends of those upwardly projecting receptacles.

15. A raised platform, including in combination a rectangular frame having four load-bearing tee bars, two widthwise and two lengthwise, each with a vertical flange and a horizontal flange, welded together at the corners with the horizontal flange extending inwardly of the rectangle, and a central angle bar extending widthwise across the midpoints of the lengthwise tee bars and welded to them, a series of tubular leg receptacles, one secured adjacent each corner of the rectangular frame, each leg receptacle comprising a length of square tubing disposed vertically and fully open at each end, each said receptacle having at least one set screw mounted thereon and extending therethrough, a corresponding series of square tubular legs slidably mounted in said leg receptacles and having a flat lower end, each leg having at least one set screw opening therethrough, said set screw means passing through a said set screw opening and rigidly securing each said leg to its said leg receptacle at a chosen location relative thereto, a jack screw fitting loosely in each said leg and extending therebelow, having a through diametral opening near its lower end, and a drivable head at its upper end, a jack nut threaded on each said jack screw and abutting and supporting the flat lower end of each said leg, a locking nut threaded on each said jack screw below said jack nut, and a floor resting on the horizontal flanges of said frame and abutting its vertical flanges.

16. The platform of claim 15 having a jack receptacle for receiving the lower end of each said jack screw and supporting it, said receptacle having an outwardly extending flange.

17. The platform of claim 16, wherein said jack receptacle is contained in a flat-bottomed concrete pad, said flange being embedded in and strengthening said pad.

18. A platform assembly made up of a plurality of the platforms of claim 16 secured together, the jack receptacles for closely adjacent-jacks comprising a common receptacle assembly having two spaced-apart receptacles, one for each jack screw and having a common horizontal flange, and a single concrete pad encasing said receptacles and said flange.

19. The platform of claim 15 having an outer facing above said vertical flanges of said frame.

20. The platform of claim 15 wherein the lower end of each said jack screw is attached to a wheel-support member having a rotatable wheel, so that the platform is rollable on wheels.

21. The platform of claim 15 wherein the horizontal flanges of said frame extend into said leg receptacles to provide a stop there for the leg.

22. A raised platform, including in combination a rectangular frame having four tee bars, two widthwise and two lengthwise, each with a vertical flange and a horizontal flange, welded together at the corners with the horizontal flange extending inwardly of the rectangle, and a central angle bar extending widthwise across the midpoints of the lengthwise tee bars and welded to them, a series of tubular leg receptacles, one secured adjacent each corner of the rectangular frame, each leg receptacle comprising a length of square tubing disposed vertically, a corresponding series of square tubular legs slidably mounted in said leg receptacles and having a flat lower end, set screw means for rigidly securing each said leg to its said leg receptacle at a chosen location relative thereto, a jack screw fitting loosely in each said leg and extending therebelow, having a through diametral opening near its lower end, and a drivable head at its upper end, a jack nut threaded on each said jack screw and abutting and supporting the flat lower end of each said leg, a locking nut threaded on each said jack screw below said jack nut, a floor resting on the horizontal flanges of said frame and abutting its vertical flanges, and a step assembly secured thereto, said step assembly including an additional pair of said leg receptacles, each having an associated leg, set screw means, a jack screw, a jack nut, a locking nut and a jack receptacle, a horizontal angle member bridging said pair of leg receptacles, a pair of horizontal members each normal to said horizontal angle member, one being secured to each said leg receptacle and also at its opposite end having a sleeve slidably mounted on one of said legs of said frame, and treads supported on said horizontal members.

23. The platform of claim in 22 wherein said step assembly includes an additional step assembly like that recited in claim 22 with its said sleeves mounted on the leg of the formerly stated assembly.

24. The platform of claim 23 wherein one said leg at the lowest said step projects above the step and so does one leg for the platform to which the step assembly is secured and a banister secured to and connecting the upper ends of those upwardly projecting receptacles.

25. A ramp, including in combination a rectangular frame having four bars, two widthwise and two lengthwise, fastened together at the corners, and a center bar extending widthwise across the midpoints of the lengthwise bars and fastened to them, a pair of leg receptacles, one secured adjacent each corner at one end only of the rectangular frame, each leg receptacle comprising a length of tubing disposed vertically and fully open at each end, a corresponding pair of tubular legs slidably mounted in said leg receptacles for raising the lever of their end above the other end of said frame and having a flat lower end, securing means for rigidly securing each said leg to its said leg receptacle at a chosen location relative thereto, a jack screw fitting loosely in each said leg and extending therebelow, a jack nut threaded on each said jack screw and having a flat upper surface abutting and supporting the flat lower end of each said inner leg receptacle, a locking nut threaded on each said jack screw below said jack nut, and a floor restng on said frame.

26. The ramp of claim 25 having a jack receptacle for receiving the lower end of each said jack screw and supporting it, said receptacle having an outwardly extending flange.

27. The ramp of claim 25 having castors attached to the lower end of each said jack screw.

28. A ramp, including in combination a rectangular frame, having four bars, two widthwise and two lengthwise, each with a vertical flange and a generally horizontal flange, welded together at the corners with the generally horizontal flange extending inwardly of the rectangle, and a center angle bar extending widthwise across the midpoints of the lengthwise bars and welded to them, a pair of leg receptacles, one secured adjacent each corner at one end only of the rectangular frame, each leg receptacle a length of square tubing disposed vertically, a corresponding pair of square tubular legs slidably mounted in said leg receptacles for raising the level of their end of the frame above that of the other end of the frame, and having a flat lower end, set screw means for rigidly securing each said leg to its said leg receptacle at a chosen location relative thereto, a jack screw fitting loosely in each said leg and extending therebelow, having a through diametrical opening near its lower end and a drivable head at its upper end, a jack nut threaded on each said jack screw and having a flat upper surface abutting and supporting the flat lower end of each said inner leg receptacle, a locking nut threaded on each said jack screw below said jack nut, and a floor resting on the horizontal flanges of said frame and abutting its vertical flanges.

29. The ramp of claim 28 having a jack receptacle for receiving the lower end of each said jack screw and supporting it, said receptacle having an outwardly extending flange.

30. The ramp of claim 28 having a castor on the lower end of each said jack screw.

* * * * *